US006461099B1

(12) United States Patent
Gosz

(10) Patent No.: US 6,461,099 B1
(45) Date of Patent: Oct. 8, 2002

(54) LOADER LINKAGE WITH RACK STOPS

(75) Inventor: Jeffrey S. Gosz, Chicago, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/688,565

(22) Filed: Oct. 16, 2000

(51) Int. Cl.[7] ..... E02F 9/00

(52) U.S. Cl. ..... 414/701; 414/722

(58) Field of Search ..... 414/697, 722, 414/701, 715

(56) References Cited

U.S. PATENT DOCUMENTS

| | | | | |
|---|---|---|---|---|
| 3,336,684 A | | 8/1967 | Ulrich | |
| 4,428,173 A | * | 1/1984 | Knell | 414/722 X |
| 4,768,917 A | | 9/1988 | Garman | |

* cited by examiner

*Primary Examiner*—Donald W. Underwood
(74) *Attorney, Agent, or Firm*—Nexsen Pruet; Liza J Meyers

(57) ABSTRACT

A loader is provided with rack stops on a pair of side walls of a loader boom which abut rack stops beneath opposite ends of a pair of implement tilt links to stop rack back movement of an implement pivotally mounted on one end of the boom.

20 Claims, 3 Drawing Sheets

LOADER LINKAGE WITH RACK STOPS

TECHNICAL FIELD

This invention relates generally to linkages for construction machinery and more particularly to stops for stopping rack back movement of an implement.

BACKGROUND ART

Wheel loaders and track loaders have linkages for pivoting a bucket between a loading position, a transporting position and a dumping position. In a loading operation, a bucket is driven into the material being loaded and the bucket is pivoted to a rolled back or racked back position against a pair of rack stops. The rack stops are engaged by the bucket or a bucket tilt linkage. The impact of the engagement of the rack stops, particularly with a loaded bucket, places considerable stress on the rack stops and on the components carrying the rack stops. With the increasing load capacity of loader buckets, some with over 30 cubic meter capacity, the rack stops, the linkage and the components supporting the rack stops are being subjected to increasingly greater impacts and stresses. The impacts result in deformation of the rack stops and structural damage to the components carrying the rack stops. In loader linkages having a rack stop located at an intermediate point on a link, it has been found necessary to increase the cross section of the link in order to withstand the bending stress imposed on the link when the rack stop is engaged. This increases the cost and weight carried by the lift cylinder and results in a reduction in machine payload. In some loaders, the rack stops are located in the primary load paths of the structure and thus the impact on the rack stops undesirably increases the stress in that part of the component. This results in additional structural members being added to withstand the stress. Again, the weight and cost are increased and the payload capacity is decreased. In the design of a loader linkage, it is desirable to have gradual changes of direction in the structure to avoid points of stress concentration. Some prior loaders have incorporated rack stops in a manner that results in some highly stressed points in the structure.

U.S. Pat. No. 4,768,917 issued Sep. 6, 1988 to Anthony L. Garman for Loader Boom Mechanism discloses a loader linkage. A single bucket tilt link has a rack stop beneath its bucket connecting end which abuts a rack stop in the form of a large reinforced projection on the top wall of a hollow boom. The projection is laterally centered on the top wall of the boom and above a pivot connection between the boom and the bottom end of a tilt lever. The rack stop on the boom is in a primary stress path in the top wall of the boom and therefore the rack back impact on the rack stop detrimentally increases the stress in a top wall and may result in a deformation.

The present invention is directed to overcoming one or more of the problems as set forth above.

DISCLOSURE OF THE INVENTION

In one aspect of the present invention, rack stops are positioned on a loader boom remote from the primary load paths of the boom, thus avoiding the need to add additional structure to the boom to withstand the additional stress in the primary load paths. This minimizes cost of material and maximizes payload capacity. In another aspect of the present invention, the rack stops on the tilt links have abutment surfaces which are normal to the pivot pins connecting the tilt links to the upright tilt levers. The rack back impact force is passed in compression through the ends of the tilt links directly to the pins without subjecting the tilt link to bending stress. This avoids the necessity of adding structure, and weight, to the tilt links to withstand the additional stress imposed on the tilt links if the rack back force were not passed directly to the pivot pins.

BEST MODE FOR CARRYING OUT THE INVENTION

Figure 1:
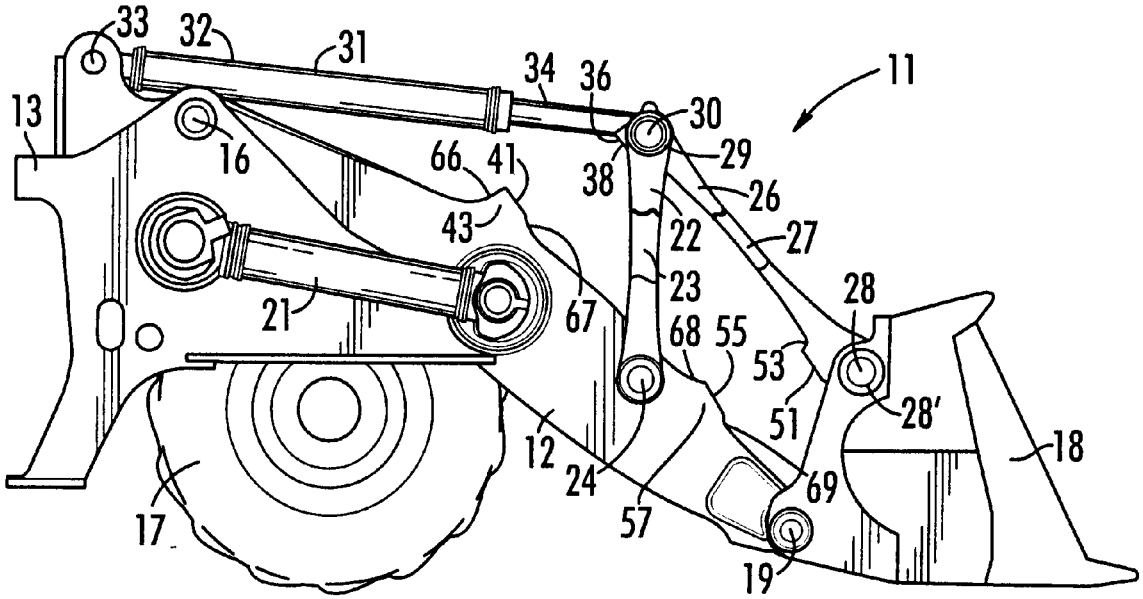
FIG. 1 is a partial side view of a wheel loader having an embodiment of the present invention.
Figure 2:
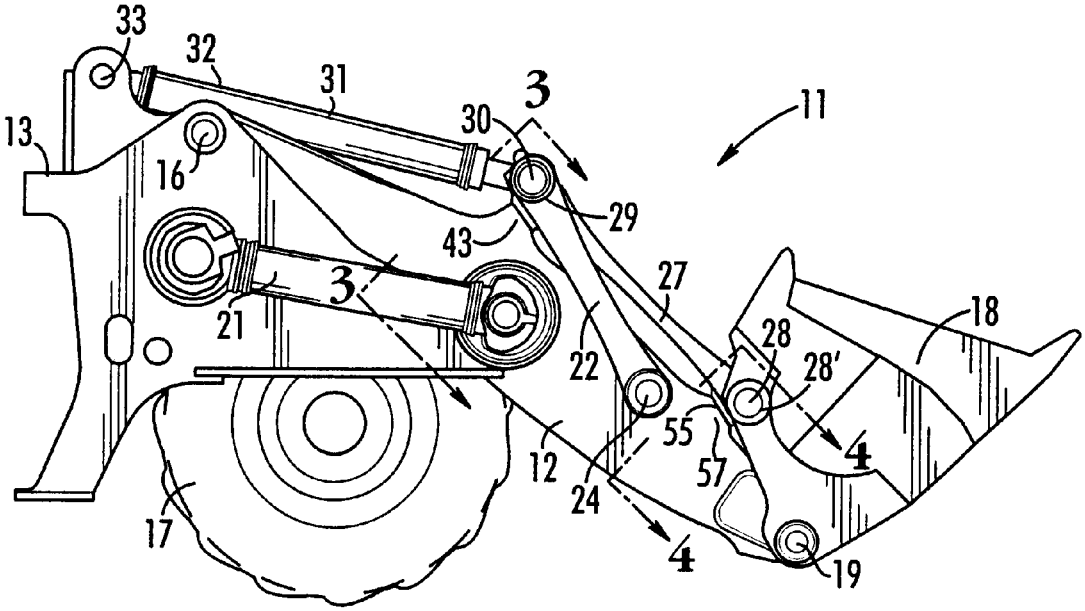
FIG. 2 is a partial side view of the wheel loader of FIG. 1 showing an implement in a racked back position.

Referring to FIG. 1, a front portion of a rubber tired loader 11 is shown including an elongated boom 12 pivotally connected to a vehicle chassis 13 for vertical swinging movement about a horizontal boom pivot axis 16 transverse to the forward and rearward movement of the loader 11. As an alternative, a track type loader could be used as the machine or power source without changing the essence of the invention. The chassis 13 is supported by a traction device in the form of rubber tires 17, only one of which is shown, for selective propulsion in forward and rearward directions. A work implement 18 in the form of a bucket 18 is pivotally connected to a forward end of the boom 12 on a horizontal implement pivot axis 19 parallel to the boom pivot axis 16 for pivotal movement between a loading position, in which it is illustrated, and a rack back position, as shown in FIG. 2. A hydraulic actuator or cylinder 21 is operatively positioned between the chassis 13 and the boom 12 and is extended and contracted by a hydraulic control system, not shown, to selectively raise and lower the boom 12.

The implement 18 is pivoted about the implement pivot axis 19 by an implement tilt linkage which includes a pair of upright implement tilt levers 22, 23 pivotally connected at their lower ends to the boom 12 on a horizontal tilt lever pivot axis 24 parallel to the implement pivot axis 19. The implement tilt linkage further includes a pair of laterally spaced implement tilt links 26, 27 having corresponding front ends pivotally connected to the implement 18 on a horizontal axis 28 spaced above and parallel to the implement pivot axis 19. Corresponding rear ends of the tilt links 26, 27 are pivotally connected to the upper ends of the tilt levers 22, 23 by a tilt lever pivot pin 29 on a transverse axis 30 parallel to the implement pivot axis 19. A hydraulic cylinder 31 is positioned between the chassis 13 and the tilt levers 22, 23. A cylinder housing 32 of the hydraulic cylinder 31 is pivotally connected to the chassis 13 on a transverse pivot axis 33 and a piston rod 34 of the hydraulic cylinder 31 is pivotally connected to the upper ends of the tilt levers 22, 23 and to the rearward ends of the tilt links 26, 27 by the pivot pin 29.

Figure 3:
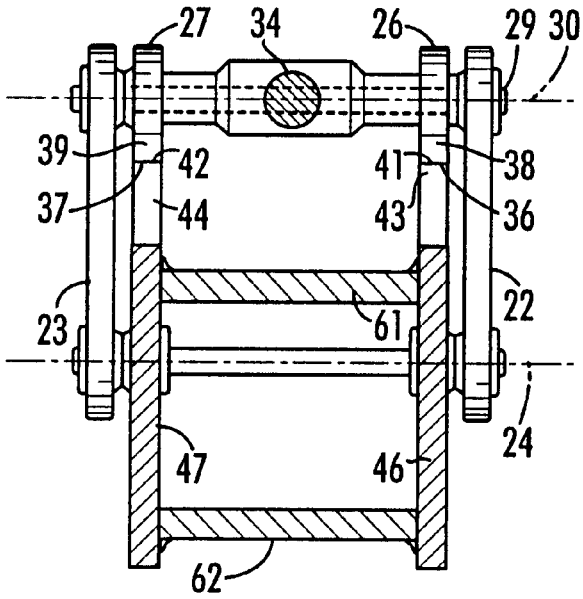
FIG. 3 is a section taken on the line 3—3 in FIG. 2.
Figure 4:
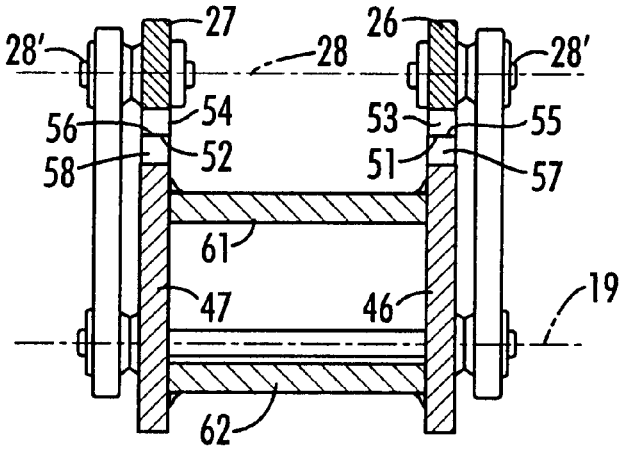
FIG. 4 is a section taken on the line 4—4 in FIG. 2.

Referring to FIGS. 2, 3 and 4, the implement 18 is shown in a racked back position. In this position a pair of downward facing abutment surfaces 36, 37 presented by a pair of upper tilt link rack stops 38, 39 are in face to face contact with a pair of upward facing and coplanar abutment surfaces 41, 42 presented by a pair of upper boom rack stops 43, 44. The upper boom rack stops 43, 44 are upward extensions of a pair of laterally opposite sidewalls 46, 47 of the boom 12. At the same time, a pair of downward facing abutment surfaces 51, 52 of a pair of lower tilt link rack stops 53, 54, which are formed on the underside of the front ends of the tilt links 26, 27, are in face to face contact with a pair of upward facing and coplanar abutment surfaces 55, 56 of a pair of lower boom rack stops 57, 58, which are portions of the side walls 46, 47 extending above a top wall 61 of the boom 12. The boom 12 is formed in a box construction manner wherein the side walls 46, 47 are secured, as by welding, to laterally opposite edges of the top wall 61 and to a bottom wall 62. The upper and lower boom rack stops 43, 44, 57, 58 are formed by upward continuations of the boom side walls 46, 47 and thus are remote from the primary load path in the top wall 61 of the boom 12.

Figure 5:
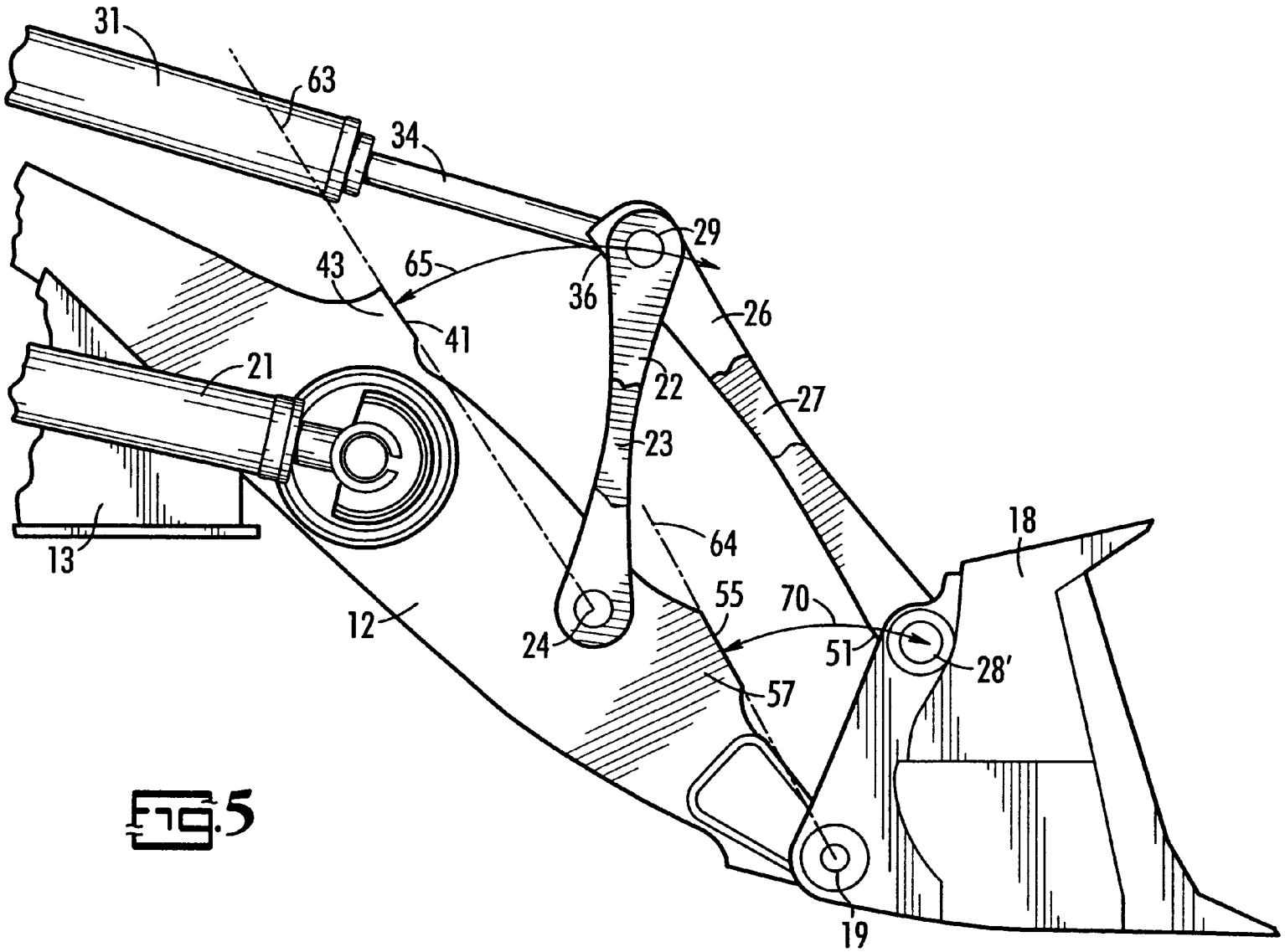
FIG. 5 is an enlarged partial side view of the loader linkage.

Referring also to FIG. 5, the abutment surfaces 41, 42 of the upper rack stops 43, 44, lie in a plane 63 passing through the horizontal tilt lever axis 24 and the abutment surfaces 55, 56 lie in a plane 64 passing through the implement pivot axis 19. Thus the abutment surfaces 41, 42 are in radial alignment with the horizontal tilt lever pivot axis 24 and the abutment surfaces 55, 56 are in radial alignment with the implement pivot axis 19. As illustrated by the arc 65, the upper boom rack stops 43, 44 are located tangentially with respect to the pivot pin 29 and, as illustrated by the arc 70, the lower boom rack stops 57, 58 are located tangentially with respect to the pivot pin 28'.

As will be noted in FIGS. 1 and 2, a pair of generous fillets 66, 67 are provided at the longitudinally opposite ends of the upper boom rack stop 43 to form a gradual transition from the abutment surface 41 to the part of the side wall 46 connected to the top wall 61. In a like manner a pair fillets 68, 69 are provided at longitudinally opposite ends of the abutment surface 55 of the lower boom rack stop 57. The boom rack stops 44, 58 are constructed in a similar manner.

INDUSTRIAL APPLICABILITY

Wheel loaders and track loaders are often engaged in repetitive work cycles which include racking back of the loaded bucket 18. When the implement 18 is racked back, the impact of the implement 18, with its payload, is transmitted from the rack stops 38, 39, 53, 54 beneath the ends of the tilt links 26, 27 to the rack stops 43, 44, 57, 58 on the vertically disposed boom side walls 46, 47. The thrust of the rack back impact is in line with the vertically disposed side walls 46, 47 which are properly oriented to withstand the additional load. The generous fillets 66, 67, 68, 69 serve to longitudinally distribute the impact load to the side walls 46, 47, thus avoiding stress risers. This location of the rack back stops 43, 44, 57, 58 avoids rack back impact loading of the top wall 61 of the boom 12 in which a primary load path of the boom 12 is located. The radial alignment of the abutment surfaces 41, 42 with the tilt lever pivot axis 24 and the radial alignment of the abutment surfaces 55, 56 with the bucket pivot axis 19 avoids shear load being transmitted to these surfaces upon a bucket rack back impact. By locating the boom rack stops 43, 44 tangentially with the pivot pin 29 and by locating the boom rack stops 57, 58 tangentially with the pivot pin 28', the tilt links 26, 27 are not subjected to a bending stress during a rack back of the bucket 18. Since the rack back impact load is normal to the pivot pins 29, 28' and moment loading of the tilt links 26, 27 is avoided, it is not necessary to add additional structure to the tilt links 26, 27 to withstand bending stress. This invention provides rack back stops 38, 39, 43, 44, 53, 54, 57, 58 which distribute the impact load of an implement rack back to the side walls 46, 47 of the boom 12 without endangering the structural integrity of the boom 12 and without requiring substantial additional structural material in the boom 12 or the tilt links 26, 27. This structural arrangement minimizes the cost of material and maximizes machine payload capacity.

Other aspects, objects and advantages of this invention can be obtained from a study of the drawings, the disclosure and the appended claims.

What is claimed is:

1. A loader having a chassis being supported by a traction device for selective propulsion in a forward direction and in a rearward direction, comprising:

an elongated boom having a front end and a rear end, said rear end being pivotally connected to said chassis about a horizontal boom pivot axis permitting vertical swinging movement of said boom, said boom including a pair of laterally spaced vertical side walls, a top wall and a bottom wall, said top and bottom walls extending laterally between and being secured to said side walls;

a work implement being pivotally connected to said front end of said boom and a horizontal implement pivot axis parallel to said boom pivot axis for swinging movement between a loading position and a racked back position;

a hydraulic cylinder between said chassis and said boom;

an implement tilt linkage including:

a pair of upright implement tilt levers having upper and lower ends; said lower ends being pivotally connected to a respective one of said side walls of said boom on a horizontal lever pivot axis parallel to said implement pivot axis; and a pair of laterally spaced implement tilt links having corresponding front ends pivotally connected to said implement on a horizontal axis spaced above and parallel to said implement pivot axis and having corresponding rear ends pivotally connected to said upper ends of said tilt levers on a transverse pivot axis parallel to said implement pivot axis;

a hydraulic cylinder between said chassis and said tilt levers selectively operable to pivot said tilt levers about said tilt lever pivot axis to effect said swinging movement of said implement between said loading position and said rack back position;

an upper tilt link rack stop positioned on the underside of said rear end of each one of said pair of tilt links including a downwardly facing abutment surface; and a pair of laterally spaced upper boom rack stops secured to, aligned with and extending upwardly from said sidewalls of said boom, said upper boom rack stops having upward facing abutment surfaces, respectively;

said abutment surfaces of said upper tilt link rack stops being in face to face contact, respectively, with said abutment surfaces on said upper boom rack stops when said implement is in said racked back position.

2. The loader of claim 1 wherein said top wall of said boom has a primary load path and wherein said abutment surfaces of said upper boom rack stops are remote from said primary load path.

3. The loader of claim 1 wherein said abutment surfaces of said upper boom rack stops are in coplanar relation with said tilt lever pivot axis.

4. The loader of claim 1 wherein said upper boom rack stops are portions of said pair of side walls, said upper boom rack stops projecting above said top wall of said boom.

5. The loader of claim 4 wherein the longitudinally opposite ends of each of said boom rack stops slope gradually downward and in longitudinally opposite directions from said abutment surfaces of said rack stop.

6. The loader of claim 1 wherein said tilt links are connected to said tilt levers by a tilt lever pivot pin and wherein said abutment surfaces on said upper tilt link rack stops are positioned to transmit impact load to said tilt lever pivot pin when said implement is pivoted to said racked back position without subjecting said tilt levers to substantial bending stress.

7. The loader of claim 6 wherein said upper boom rack stops are portions of said side walls projecting above said top wall of said boom.

8. The loader of claim 1 wherein said implement tilt links are in substantial vertical alignment with said side walls of said boom.

9. The loader of claim 1 including:

a lower tilt link rack stop formed on the underside of said front end of each of said tilt links, each of said lower tilt link rack stops having a downwardly facing abutment surface and a pair of laterally spaced lower boom rack stops formed, respectively, as upward extensions of said side walls of said boom, said lower boom rack stops having upward facing abutment surfaces which abut, respectively, said abutment surfaces of said lower tilt link rack stops when said implement is in said racked back position.

10. The loader of claim 9 wherein said abutment surfaces of said lower boom rack stops are coplanar with said implement pivot axis.

11. The loader of claim 9 wherein said top wall of said boom has a primary load path and wherein said upper and lower rack stops on said boom are in remote relation to said load path.

12. The loader of claim 9 wherein said upper and lower boom rack stops are portions of said pair of side walls of said boom extending above said top wall of said boom.

13. The loader of claim 9 wherein the pivot connection between said rear ends of said tilt links and said upper ends of said tilt levers includes a tilt lever pivot pin, wherein the pivot connection between said front ends of said tilt links and said implement includes a pivot pin and wherein said abutment surfaces on said boom and said abutment surfaces on said tilt links are positioned to transfer impact load to said pivot pins without subjecting said tilt links to substantial bending stress.

14. A loader linkage comprising;

an elongated boom having a front end and a rear end, said rear end being adapted for connection to a support for vertical swinging movement, said boom including a pair of laterally spaced vertical side walls and a top wall extending between said pair of side walls;

a work implement being pivotally connected to said front end of said boom on a horizontal implement pivot axis for pivotal movement between a loading position and a racked back position;

a pair of implement tilt levers having upper ends and lower ends, said lower ends being pivotally connected to a respective one of said side walls of said boom on a horizontal tilt lever pivot axis parallel to said implement pivot axis;

a pair of laterally spaced implement tilt links having corresponding front ends pivotally connected to said implement on a horizontal axis spaced above and parallel to said implement pivot axis and having corresponding rear ends pivotally connected to said tilt levers by a tilt lever pivot pin on a transverse pivot axis parallel to said implement pivot axis;

an upper tilt link rack stop positioned on the underside of said rear end of each of said pair of tilt links including a downward facing abutment surface; and a pair of laterally spaced upper boom rack stops secured to, aligned with and extending upwardly from said sidewalls of said boom, each of said upper boom rack stops having an upward facing abutment surface;

said abutment surfaces of said upper tilt link rack stops being in face to face contact with said abutment surfaces on said upper boom rack stops when said implement is in its racked back position.

15. The loader linkage of claim 14 wherein said upper boom rack stops are portion of said side walls projecting above said top wall of said boom.

16. The loader linkage of claim 15 wherein said implement tilt links are in substantial vertical alignment with said side walls of said boom.

17. The loader linkage of claim 14 wherein said abutment surfaces of said upper boom rack stops are coplanar with said tilt lever pivot axis.

18. The loader linkage of claim 17 wherein said upper boom rack stops are upward projections of said side walls of said boom and said tilt links are vertically aligned, respectively, with said side walls.

19. The loader linkage of claim 18 wherein said upper boom rack stops and said upper tilt link rack stops are positioned to transfer impact load due to racking back of said implement to said pivot pin without subjecting said tilt links to substantial bending stress.

20. A method of structuring rack back stops on a loader of the type having a chassis, an elongated boom pivotally connected at one end to said chassis and an implement pivotally connected to the other end of said boom on a horizontal transverse pivot axis for pivotal movement between a loading position and a racked back position, comprising the steps of:

forming said boom with a top wall and a pair laterally spaced side walls secured to said top wall with portions of said side walls extending above said top wall to form a pair of rack stops with upward facing coplanar abutment surfaces, respectively;

providing a pair of tilt levers having lower ends pivotally connected, respectively, to said side walls on a transverse pivot axis coplanar with said abutment surfaces and having upper ends; and providing a pair of tilt links in alignment with said side walls, said tilt links having front ends pivotally connected to said implement and having rear ends pivotally connected to said upper ends of said tilt levers, said tilt links being formed with rack stops beneath their rear ends, said rack stops having abutment surfaces which make face to face contact with said abutment surfaces, respectively, of said rack stops, when said implement is pivoted to said racked back position, without imparting substantial bending stress to said tilt links.

* * * * *